US005368345A

United States Patent [19]

Watts

[11] Patent Number: 5,368,345

[45] Date of Patent: Nov. 29, 1994

[54] DOOR LOCK

[76] Inventor: John R. Watts, 42 Export Drive, City-Link Estate, Francis Street, Brooklyn, Victoria 3025, Australia

[21] Appl. No.: 986,051

[22] Filed: Dec. 10, 1992

Related U.S. Application Data

[63] Continuation-in-part of Ser. No. 582,875, Oct. 12, 1990, abandoned.

[51] Int. Cl.[5] ..... E05C 1/12

[52] U.S. Cl. ..... 292/1.5; 292/167; 70/143; 70/152

[58] Field of Search ..... 292/1.5, 167, 169.13–169.16, 292/181, 336.3, 336.5; 70/107, 110, 111, 143–145, 221–224, 470, 478–480, 489, 150–152

[56] References Cited

U.S. PATENT DOCUMENTS

| | | | |
|---|---|---|---|
| 2,327,071 | 8/1943 | Schlage | 70/143 X |
| 2,959,952 | 11/1960 | Schweitzer | 70/479 |
| 3,112,944 | 12/1963 | Adler | 292/1.5 X |
| 3,586,361 | 6/1971 | Ohno | 70/143 X |
| 3,621,685 | 11/1971 | Sargent | 70/107 |
| 3,769,822 | 11/1973 | Yulkowski | 70/152 |
| 3,912,309 | 10/1975 | Fischer et al. | 70/143 X |
| 4,031,725 | 6/1977 | Reid | 70/107 |
| 4,255,953 | 3/1981 | Dietrich et al. | 292/169.15 X |
| 4,333,324 | 6/1982 | Dietrich et al. | 70/143 X |
| 4,594,864 | 6/1986 | Hart | 70/143 |
| 4,656,849 | 4/1987 | Rotondi et al. | 70/143 X |
| 4,687,239 | 8/1987 | Lin | 70/461 |
| 4,759,576 | 7/1988 | Ching | 292/1.5 |
| 4,765,663 | 8/1988 | Raymond et al. | 292/1.5 X |
| 4,772,055 | 9/1988 | Fang | 292/1.5 |
| 4,945,737 | 8/1990 | Hart | 70/143 |
| 4,957,315 | 9/1990 | Lin | 292/1.5 |
| 5,020,343 | 6/1991 | Hart et al. | 70/143 |
| 5,044,182 | 9/1991 | Totten | 70/143 |
| 5,058,940 | 10/1991 | Hart | 292/167 |
| 5,177,987 | 1/1993 | Shen | 70/479 X |

FOREIGN PATENT DOCUMENTS

| | | |
|---|---|---|
| 28377/77 | 3/1979 | Australia . |
| 328325 | 3/1976 | Austria . |
| 2176334 | 10/1973 | France . |
| 1032685 | 12/1958 | Germany . |
| 1183402 | 8/1965 | Germany . |
| 394172 | 6/1983 | United Kingdom . |
| 486963 | 6/1988 | United Kingdom . |
| WO85/01771 | 4/1985 | WIPO . |

*Primary Examiner*—Peter M. Cuomo
*Assistant Examiner*—Suzanne L. Dino
*Attorney, Agent, or Firm*—Sughrue, Mion, Zinn, Macpeak & Seas

[57] ABSTRACT

A multifunction hinged door lock with independently biased lever assemblies positioned one on each side of a door that drive the latch bolt of a latchbolt subassembly through the medium of a drive slide positioned for slidable movement in the sub assembly. The lever assemblies include at least one lock actuator such as a keyed cylinder to optionally displace at least one locking device between locked and unlocked configurations.

The subassembly may optionally include an extended length bolt, a detent to restrain the bolt from fully extending prior to latching and optionally also include a detent to restrain the bolt from fully displacing prior to locking. The subassembly may optionally include an extended length bolt with a latching lever to assist initial latching.

The subassembly may also optionally include a facility whereby inward displacement of the bolt during latching drives the locking device to the unlocked position if it were actuated to the locked position prior to latching.

19 Claims, 9 Drawing Sheets

DOOR LOCK

RELATED APPLICATION

This application is a continuation-in-part of application Ser. No. 07/582,875, filed Oct. 12, 1990, now abandoned, which is herein incorporated by reference.

BACKGROUND OF THE INVENTION

This invention relates in general to locksets and more particularly, though not exclusively, to locksets comprising levers as distinct from knobs and having a latch bolt of extended length.

SUMMARY OF PRIOR ART

Common locksets with knobs generally comprise a central casing accommodating a slidable carriage which in application is connected to an armed extension of a latch bolt supported in a sub assembly and having a one half inch displacement.

Tubular bosses projecting coaxially from both sides support internal independent drive shafts terminating on the external end in an operable knob and terminating on the other end within the casing in arms engageable with the carriage. Rotation of the knob causes the shafts to displace the carriage against bias to cause the bolt to retract; knobs are biased to the unrotated position by the spring biased carriage. The distance between knobs is fixed and door thickness variation is accommodated by threaded engagement between the bosses and fixing roses which are longitudinally adjustable along the bosses.

Also common is a spindle interconnecting the lock actuating means in each knob, these most commonly being key operable cylinders or thumbturns. Some common functions require that a locked knob be unlocked by door closure and this is accomplished by means including engagement between the spindle and carriage. This is readily achieved because of the fixed distance between knobs.

It has been found in practice that, although suitable for knobs, the above described common lockset cannot provide adequate biasing for levers.

A common method of addressing this deficiency is by providing independent lever assemblies whereby each lever is independently biased by a substantial spring. Each handle is typically interconnected by a single drive shaft which passes through the latch bolt assemby which it operates. This type of assembly is applicable to knobs as well as lever. but is particularly suited to levers. A typical assembly of this type is described in Australian Patents 16744/67 Ogden and 71571/74 Ogden which are inclusive of independent spring biasing of each knob. A typical latch bolt subassembly suitable for use with this type of handle is described in Australian Patent 30700/67 Ogden which for operation requires a single through drive shaft. The general structure described immediately above while addressing lever biasing does not provide for a locked knob to be unlocked by door closure nor does it provide for an extended length bolt.

U.S. Pat. No. 4,594,864, Hart, Jun. 17, 1986 provides a lockset having an extended length bolt with a single drive shaft. This patent describes a lockset having a latch bolt assembly including an extended length bolt displaceable between a retracted position, a partially extended position and a fully extended position, a drive shaft extending through the latch bolt assemby, means connecting the drive shaft to the bolt for moving the bolt between its positions upon rotation of the shaft and a lever assembly including a locking means. Actuation of the locking means to the locked position rotates the drive shaft to allow the bolt to displace to the fully extended position.

U.S. Pat. No. 4,333,324, Dietrich, Jun. 8, 1982 describes a similar lockset having a single drive shaft where locking the lock allows the latch bolt to displace to a fully extended position. Extension and retraction of the latch bolt to and from deadbolt position is accomplished by manipulation of a main cam, through the agency of a key or turn button.

OBJECTS OF THE INVENTION

It is therefore among the objects of the invention to provide a new and improved lockset with independently biased levers each lever being connected by independent drive shafts to drive mechanisms which are engageable with a bolt actuating means.

Still another object of the invention is to provide a new and improved lockset with independently biased levers where unlocking can be achieved by inward displacement of the latch bolt during latching with a strike plate.

Still another object of the invention is to provide a new and improved lockset which provides an extended length latch bolt which although restrained to a partly extended position by a detent displaces to a fully extended position on latching to provide greater security.

Still another object of the invention is to provide a new and improved lockset which provides an extended length latch bolt which although restrained to a partly extended position by a detent is displaceable to a fully extended position after latching by actuation of a lock actuating means to the locked position; such as turning a locking cylinder key.

Still another object of the invention is to provide a new and improved lockset which provides a lockset having an extended length latch bolt with a latching lever to assist latching.

Still further among the objects is to provide a new and improved lockset adaptable to comply with the requirements for locks of various applications such as passageways, hospitals doors, entry doors, classroom doors and many other applications as required by the American National Standard for bored and preassembled locks 15 and latches ANSI/BHMA A156.2-1989.

With these and other objects in view, the invention consists of the construction, arrangement and combination of the various parts of the device serving as an example only of one or more embodiments of the invention, whereby the objects contemplated are attained, as hereinafter disclosed in the specification and drawings, and pointed out in the appended claims.

DETAILED DESCRIPTION OF THE PREFERRED EMBODIMENTS

Figure 1:
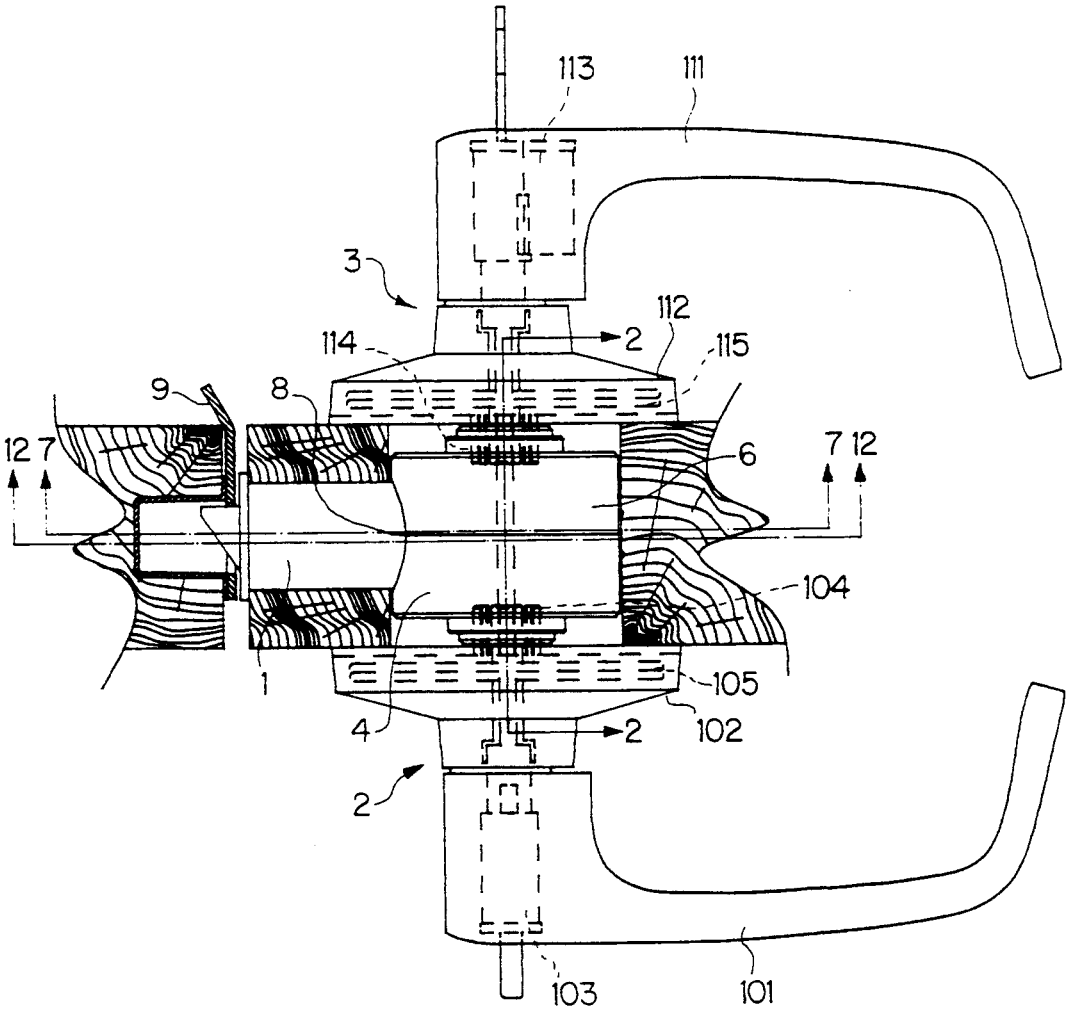
FIG. 1 is a tranverse fragmentary sectional view of a door and door jamb showing a complete lockset mounted in operating position.

A lock for a hinged door including a strike plate 9, a deadlocking latch bolt assembly I and a pair of lever sub assemblies 2 and 3 positioned one on each side of the deadlocking latch bolt assembly 1, as shown in FIG. 1.

The external lever assembly includes a fixing rose 112, a rotatable lever 111, lever biasing means 115 to urge the lever towards an undisplaced position, a substantially conventional locking means displaceable between a locked configuration and an unlocked configuration and a conventional lock actuating means 113 which optionally may be a key operable cylinder, as shown in FIG. 1.

The internal lever assembly includes a fixing rose 102, a rotatable lever 101, lever biasing means 105 to urge the lever towards an undisplaced position and a conventional lock actuating means, 103 which optionally may take the form of a thumbturn.

Figure 2:
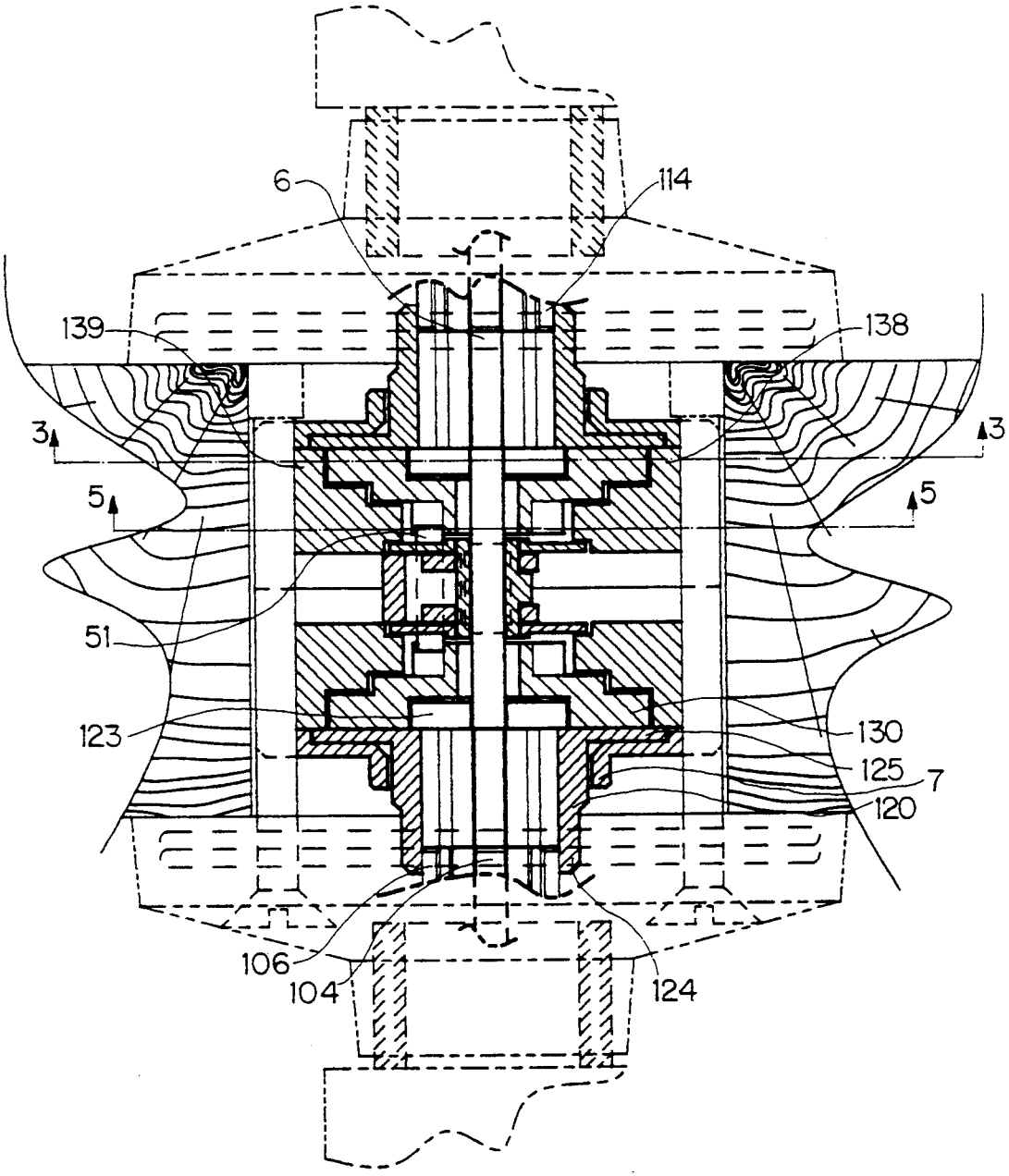
FIG. 2 is a sectional view on the line 2—2 of FIG. 1.

A through spindle 6 is provided to couple the lock actuating means to the locking means, as shown in FIGS. 1 and 2.

The invention encompasses locking means displaceable between a locked configuration where the lever is prevented from driving the adjacent shaft to rotate and an unlocked configuration where lever rotation drives the shaft to rotate. According to the above requirement the invention may encompass a lever and drive shaft construction where the shaft is permanently fixed to the lever and where the lever is securable against rotation by a conventional locking means or a lever drive shaft construction in which the lever is always free to rotate, but in which the drive between the lever and shaft is selectively disengageable by a conventional clutch.

The invention also encompasses conventional lock actuating means such as a key operable cylinder, a key operable interchangeable core or a thumb-turn in at least one lever assembly coupled to the at least one locking means for selectively displacing the locking means between locked and unlocked configurations.

Where the locking means is in one lever assembly and the actuating means is in another, a conventional spindle 6, having an axis of rotation coaxial with the drive shafts axis and preferably being of rectangular cross section, interconnects locking and lock actuating means, as shown in FIGS. 1 and 2.

Figure 8:
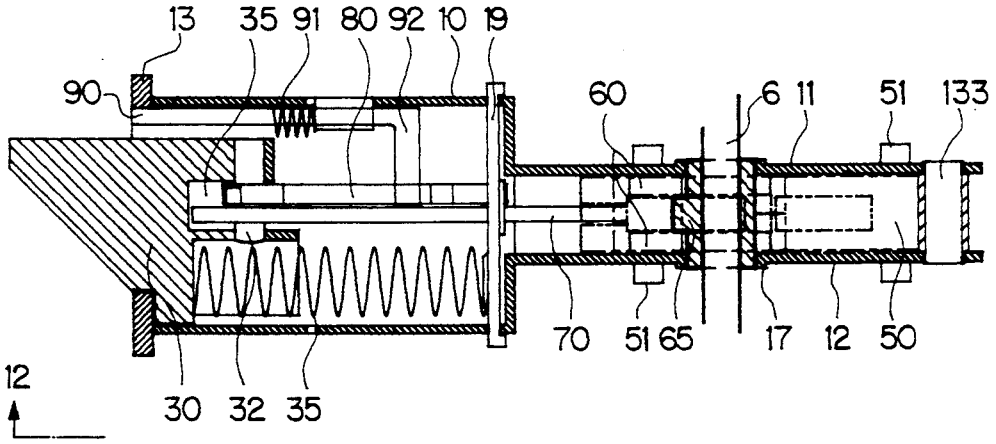
FIG. 8 is a tranverse fragmentary sectional view on the line 8—8 of the latch bolt sub assembly of FIG. 7.

Each lever assembly includes an independent drive shaft 114 and 104, as shown in FIG. 1, each with a coaxial axis of rotation. Between each lever assembly and connected to the drive shafts is a central hub 4 including a hub casing 7 comprising two shells riveted together within which the parallel plates 11 and 12, as shown in FIG. 8, of the deadlocking latch bolt assembly described below are accommodated.

Figure 3:
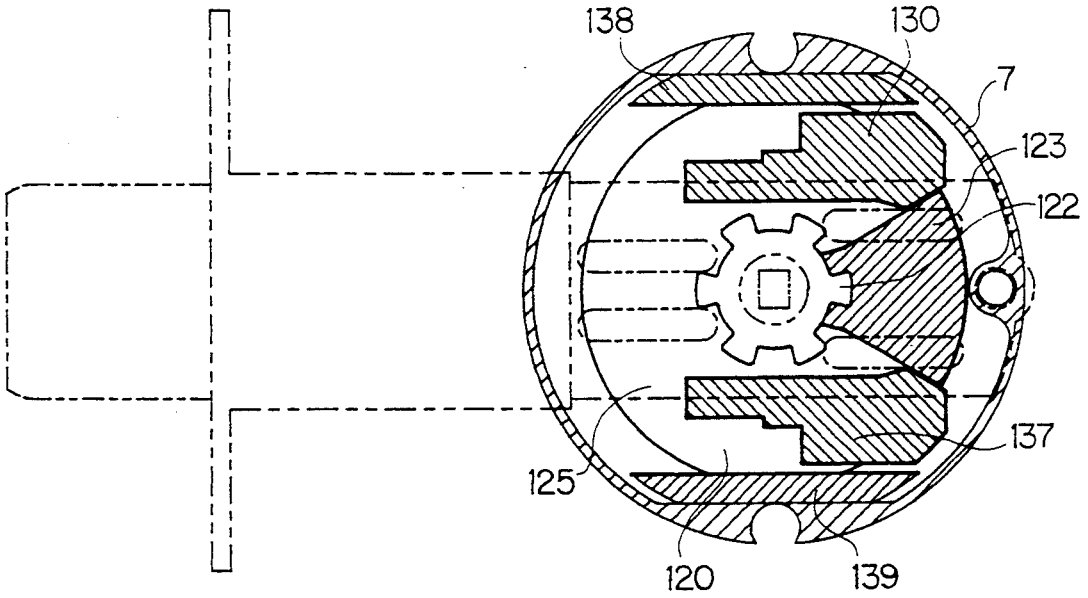
FIG. 3 is a cross-sectional view on the line 3—3 of FIG. 2.
Figure 4:
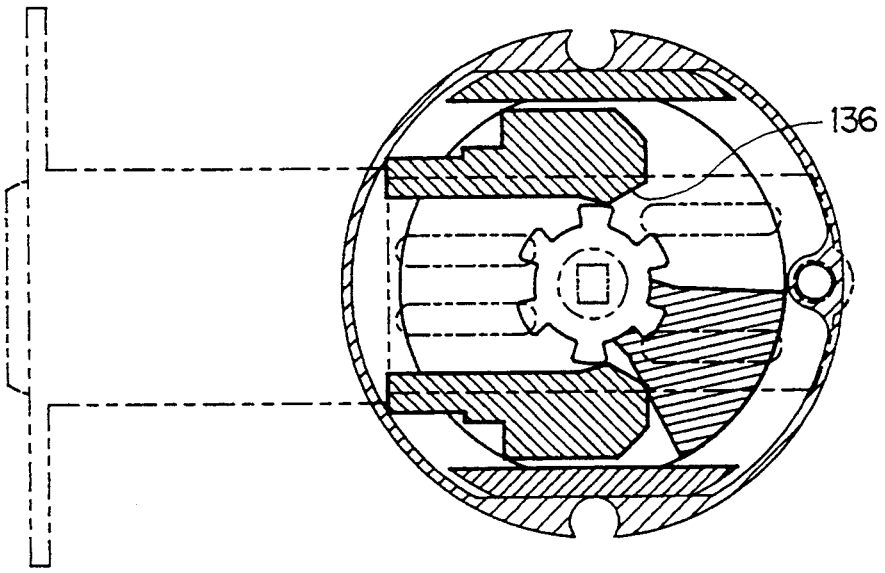
FIG. 4 is a cross-sectional view on the line 3—3 of FIG. 2.

Within the hub are two independent drive mechanisms positioned one on each side of the parallel plates and connected to the drive shaft on the same side of said drive mechanisms, converting rotational lever movement into translation in a direction parallel to that of latch bolt movement. As shown in FIGS. 2, 3 and 4, each drive mechanism includes a rotationally displaceable cam 120, having an axis of rotation coaxial with that of the drive shafts, and comprising on the outer end a tubular boss 124 which is supported in a circular hole in a wall of the hub housing while the other end is comprised of a flat orthogonal disc 125 with a raised wedge portion 123 on the face of the disc towards the back of the hub cavity.

Figure 5:
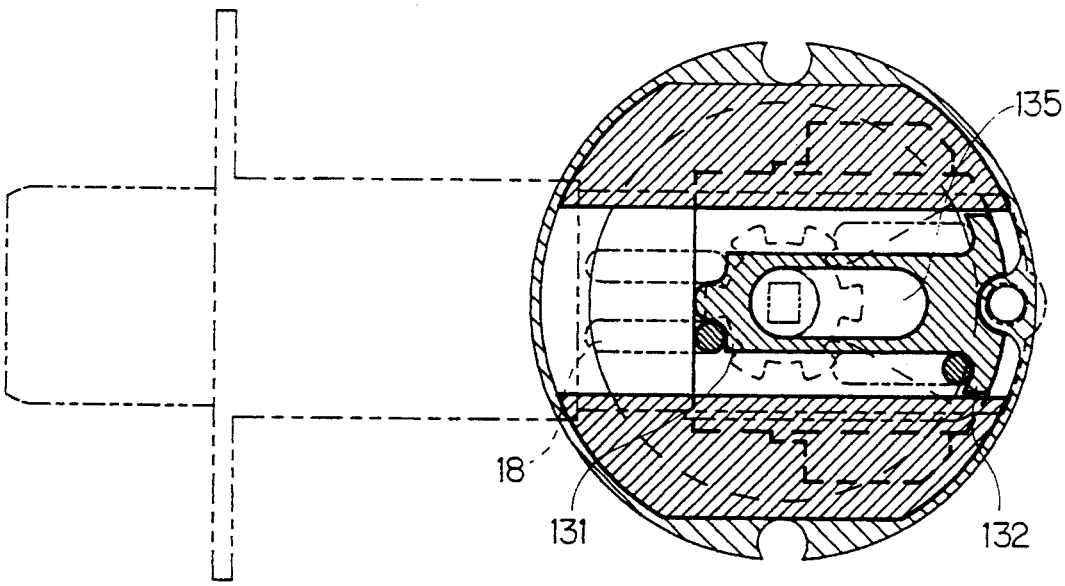
FIG. 5 is a cross-sectional view on the line 5—5 of FIG. 2.
Figure 6:
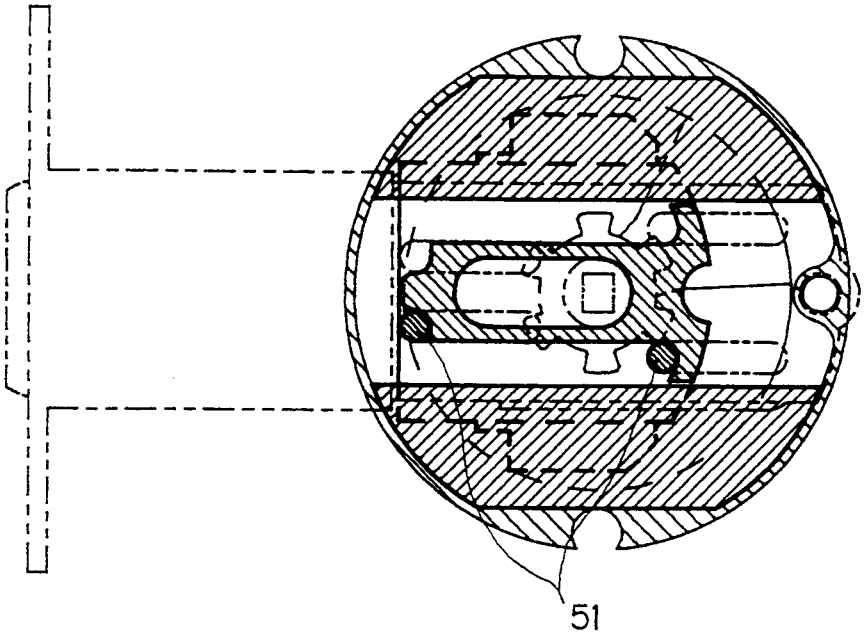
FIG. 6 is a cross-sectional view on the line 5—5 of FIG. 2.

Each drive mechanism also includes a substantially rectangular slide plate 130, as shown in FIGS. 2, 3 and 4, positioned between lower and upper parallel side rails 138 and 139 formed in the side walls of the hub casing and having a longitudinal axis parallel to latch bolt movement, as shown in FIGS. 2 and 3. Slide plate 130 has its general surface parallel to that of the adjacent surface of the disc. This slide plate is displaceable between the rails 138 and 139, as shown in FIG. 3, in a direction parallel to that of bolt movement. Towards the back edge of the slide plate there is a raised surface 137, as shown in FIG. 3, having a ramped aperture 136 in which the raised wedge portion 123 on the face of the cam disc is positioned such that part of the wedge portion 123 intrudes into the plane of the aperture 136 thereby effecting engagement. Through this engagement the cam engages the slide plate in a conventional cam follower relationship wherein cam rotation in either direction causes the slide plate to translate outwardly. On the inner face adjacent the latch bolt assembly the slide plate has raised abutments 131 and 132, as shown in FIGS. 5 and 6, spaced to engage the protruding pins 51 associated with the drive slide 50 within the latch bolt housing as described below. The drive shaft and the hub cam have a central, preferably round, throughhole, as shown in FIG. 2, to allow an interconnecting spindle 6 to pass from one lever assembly to the other while the slide plate has a central elongated hole 135 to allow an interconnecting spindle to pass from one lever assembly to the other while allowing the slide plate to displace, as shown in FIGS. 5 and 6.

The tubular boss of the hub cam is engageable with the adjacent drive shaft in such a way as to facilitate engagement when the distance between the hub and lever assembly varies according to varying door thicknesses. Preferably the drive shaft has an external spline 106, as shown in FIG. 2, while the hub cam has a matching internal spline 122, as shown in FIGS. 3 and 4, and sufficient crossover of both is provided to accommodate the range of commercially available doors.

Figure 7:
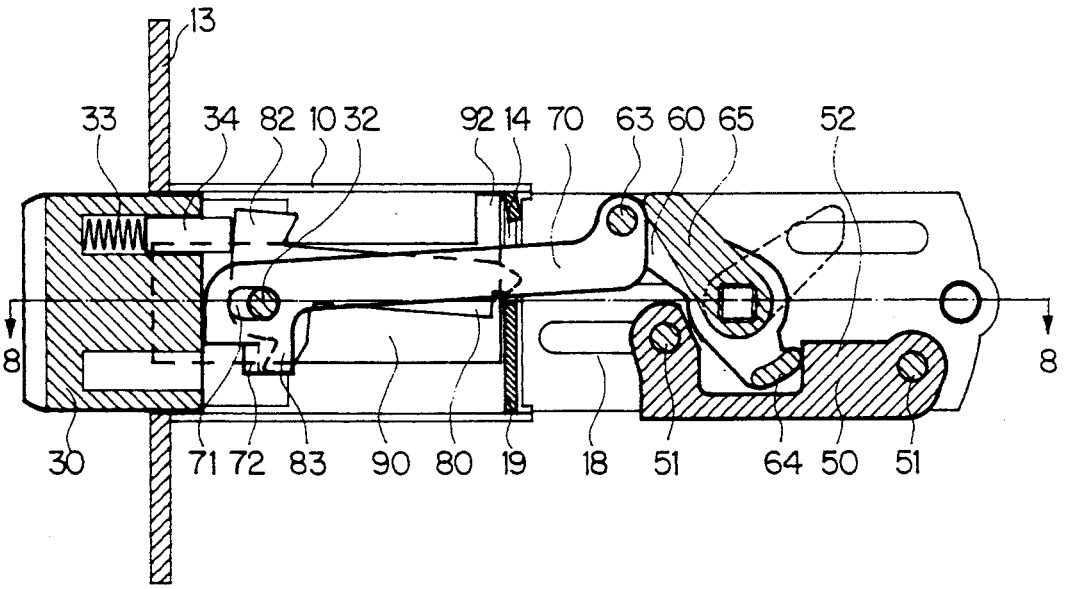
FIG. 7 is a cross sectional view on the line 7—7 of FIG. 1 of the latch bolt subassembly.
Figure 11:
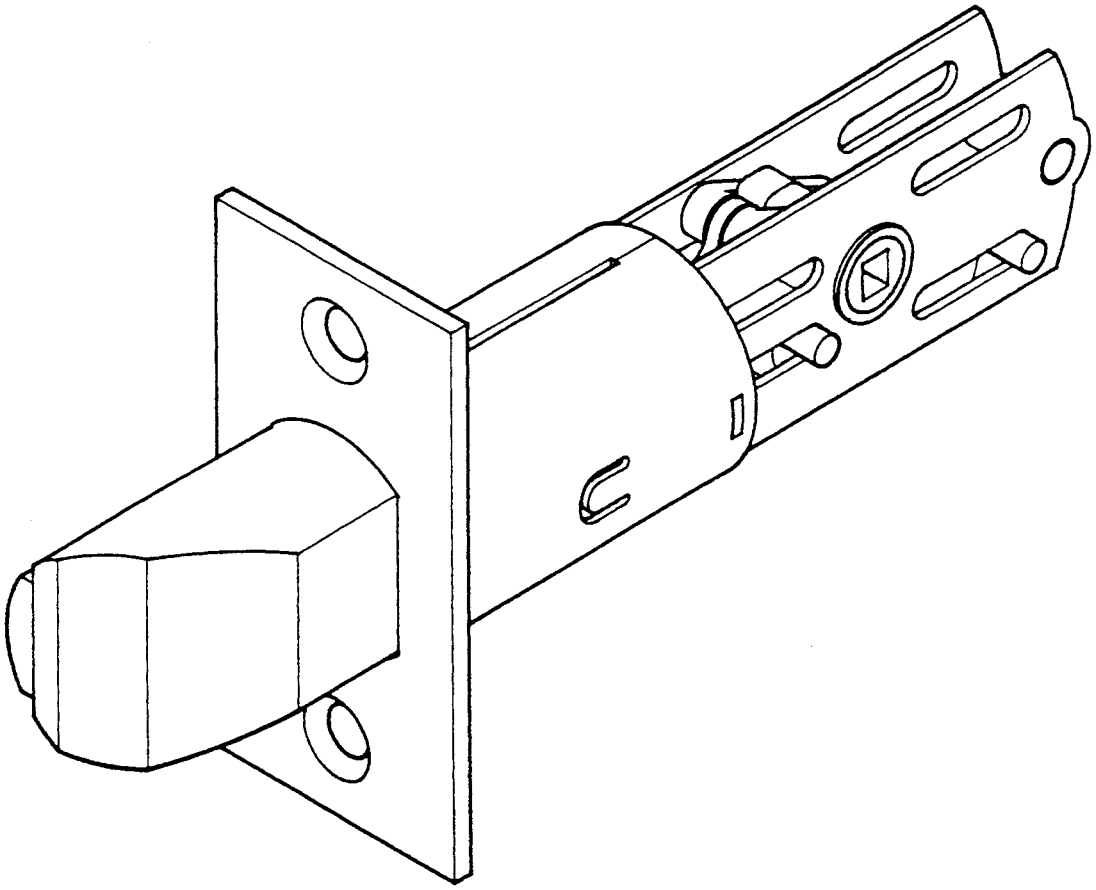
FIG. 11 is an isometric view of the latch bolt sub assembly.
Figure 13:
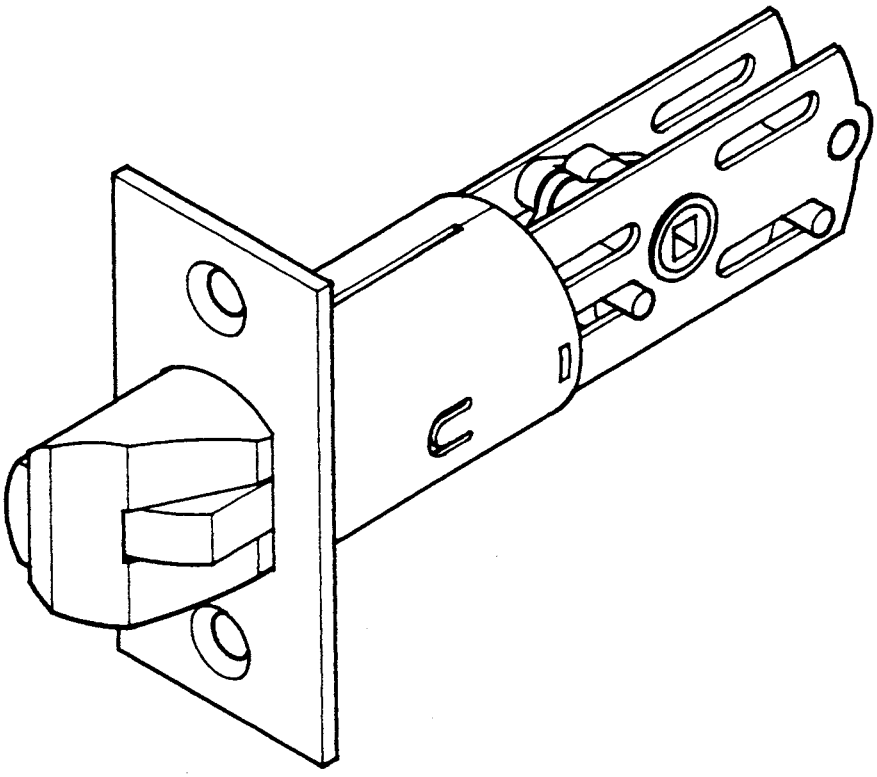
FIG. 13 is an isometric view of a latch bolt sub assembly when the latch bolt is of extended length and includes a latching lever.

The invention also includes a deadlocking latch bolt assembly I which includes a substantially tubular casing 10 comprising two halves held together by a rear rivet 133, as shown in FIGS. 7 and 8, the front end being within a circular recess in a back plate riveted to the inside of the front plate 13 which has two fixing holes, as shown in FIGS. 11 and 13, for attaching the assembly to the door, a substantially conventional latch bolt 30 supported within the casing and displaceable between an extended and a retracted position, spring biasing means 35 to urge the bolt to displace towards the extended position, as shown in FIG. 8, and bolt actuating means to cause the bolt to displace towards the retracted position. The bolt actuating means includes a connecting arm 70, as shown in FIGS. 7 and 8, one end of which is positioned within a slot 35 in the rear of the bolt, as shown in FIG. 8, and pin jointed by the transverse pin 32 to the bolt, the bolt being displaceable towards the bolt retracted position by displacement of the connecting arm.

A pivotally displaceable locking arm 80, as shown in FIGS. 7 and 8, positioned adjacent the connecting arm within the bolt slot is also connected to the bolt by the pin joint.

Figure 9:
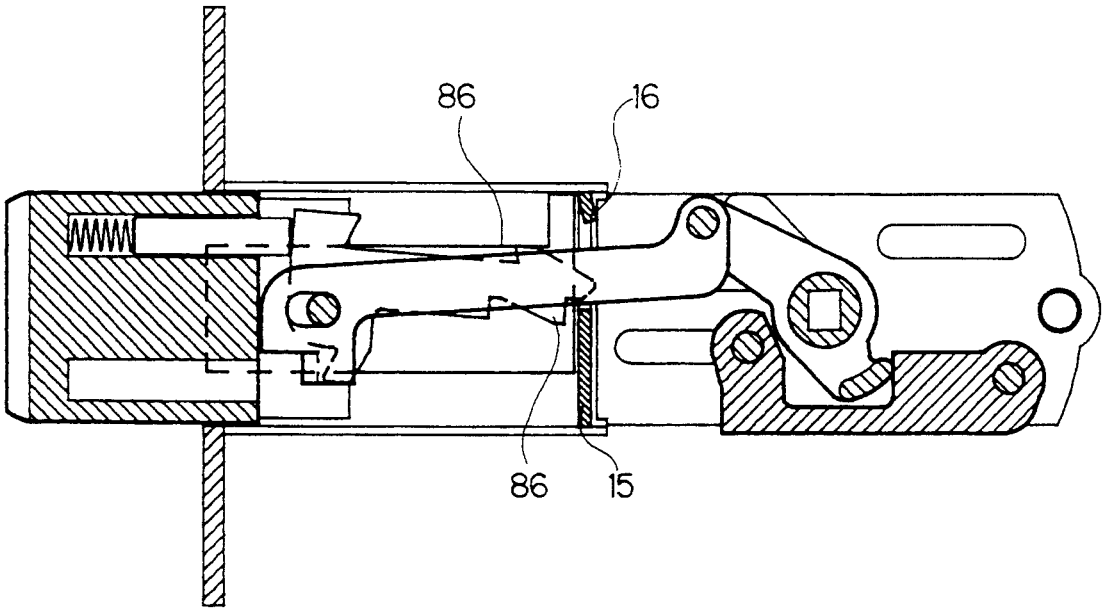
FIG. 9 is a cross sectional view on the line 7—7 of FIG. 1 of the latch bolt subassembly when the latch bolt is of extended length.

The housing has a rear wall 19, as shown in FIGS. 7 and 8, comprised of a thin circular plate with opposite tabs which project through a slot in each half of the latch bolt casing and which are bent over to assist retaining the two halves together while maintaining the wall in position. The wall includes an elongated slot 14, as shown in FIG. 7, to accommodate the passage of the connecting arm 70 and locking arm 80. At one end of the slot there is a first abutment 15, as shown in FIG. 9, engageable by a first shoulder 85, as shown in FIG. 9, on the locking arm remote from the pivot point 32.

Figure 10:
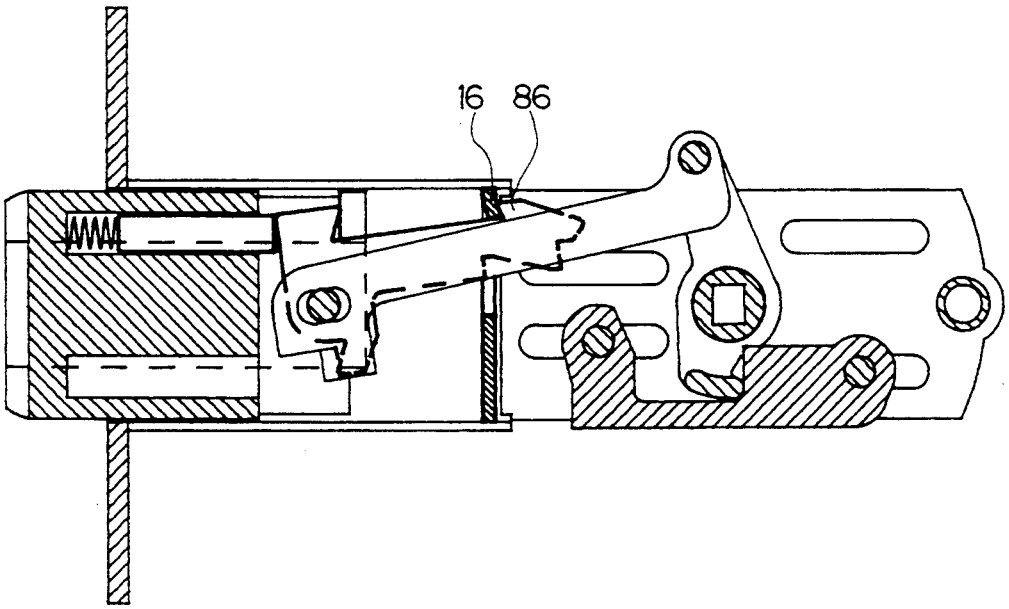
FIG. 10 is a cross sectional view on the line 7—7 of FIG. 1 of the latch bolt sub assembly when the latch bolt is of extended length.

A small cylinder 34 slideably supported longitudinally in the bolt adjacent a compression spring 33 urges a locking arm orthogonal first extension 82 of the locking arm 80, as shown in FIG. 7, to pivot and hence urges the locking arm to pivot, such pivotal displacement disposing the first shoulder 85 on the locking arm towards the rear wall first abutment 15 which when engaged, deadlocks the latch bolt to restrain it from depression. As shown in FIGS. 7 to 10, an auxiliary bolt 90 slidably supported adjacent the latch bolt is spring biased outwardly by spring 91, as shown in FIG. 8, supported in an inner longitudinal channel in the face of the auxiliary bolt adjacent the latch bolt. The auxiliary bolt facilitates inward displacement of the bolt by the strike plate 9 during latching by retaining the locking arm first shoulder 85 away from the first abutment 15. The auxiliary bolt during normal latching is undepressed and under bias extends outwardly as far as permitted by a return rearward shoulder 92, as shown in FIG. 8, which engages the rear of the latch bolt, as shown in FIG. 10. This rear shoulder concurrently engages and depresses the first locking arm extension 82, as shown in FIG. 7 against spring bias 33 thereby ensuring that the locking arm first shoulder 85 is away from the rear wall first abutment 15. Depression of the auxiliary bolt by the strike plate during latching causes the rearward shoulder 92 to disengage the first locking arm extension 82 to allow the locking arm under spring bias to pivotally displace to dispose the first locking arm shoulder 85 towards the rear wall first abutment, as shown in FIG. 7.

The bolt is retracted by inward movement of the connecting arm but prior to displacement, the bolt, if deadlocked, must be unlocked and free to translate. This unlocking is achieved through a limited translational displacement of the connecting arm 70 relative to the bolt. The connecting arm pin joint with the bolt significantly has an elongated slot 71, as shown in FIG. 7, to facilitate the above mentioned small free movement. The connecting arm also has, slightly displaced from the slot 71 and orthogonal to its general length, a return 72, as shown in FIG. 7. The locking arm has an orthogonal second extension 83 on the opposite side of the pivot point 32 from first extension 82. The small relative inward displacement of the locking arm causes the return 72 to engage and displace the adjacent second extension 83 thereby causing the locking arm to pivotally displace to move the first locking arm shoulder 85 away from the first abutment 15. The latch bolt subassembly has two parallel spaced plates 11 and 12, as shown in FIG. 8, extending rearwardly from the bolt housing, in each spaced plate 11 and 12 there is a circular hole 17 to support a minor shaft passing between the circular holes in the spaced plates and supporting between them a pivotally displaceable first pivotal member 60, as shown in FIGS. 7 to 10, comprised of two arms, as shown in FIG. 8, separated by a central slot within which an optional bladed extension to the minor shaft may pivot as described below. The above mentioned connecting arm slides within this slot and is secured by the pin joint 63 at the outer end of the slot, as shown in FIG. 7.

As shown in FIG. 7, the parallel plates also have a pair of elongated parallel slots 18 having a principal direction parallel to latch bolt movement between which a slidable drive slide 50 is supported by drive pins 51, as shown in FIG. 8, which pass from a slot in one plate to a slot in the other plate, protruding from each side to be engageable by a slide plate of the hub assembly. The first pivotal member, as shown in FIG. 7, has an axis of rotation co-axial with the axis of the drive shafts 104 and 114; on the one side of the pivot point it comprises an arm which is engageable with the connecting arm to cause the bolt to retract. The engagement may comprise a return shoulder on the connecting arm projecting into the same plane as the arm of the first pivotal member but preferably it comprises a pin joint 63. As shown in FIG. 7, on the opposite side of the pivot point from the arm the first pivotal member has a counter pivoting arm 64 which is engageable by a shoulder 52 of the drive slide 50 whereby the drive slide may engage and cause the counter pivoting arm to pivot forward thereby causing the arm of the first pivotal member to pivot backwards thereby displacing the connecting arm inwardly and causing the latch bolt to displace towards the retracted position.

Although not essential, it is preferable as mentioned above that the first pivotal member 60 and the connecting arm are pin jointed. It is also preferable that the bolt and connecting arm are pin jointed.

The deadlocking latch bolt assembly may also optionally include a second pivotal member 65, as shown in FIG. 7, being an adaption of the minor shaft whereby the minor shaft has a bladed extension slidable within the slot between the arms of the first pivotal member to be driven by the first pivotal member or connecting arm whereby in operation the spindle and second pivotal member are coupled and are rotationally displaceable in one direction coincidently with actuation of the lock actuating means to the locked configuration, and displaceable in the opposite direction by inward displacement of the bolt causing the connecting arm to drive the second pivotal member whereby the locking means is coincidently displaced to the unlocked configuration.

Preferably the shaft of the second pivotal member has a central rectangular through hole to accept a rectangular spindle.

The latch bolt may optionally be of extended length in which case the latch bolt is displaceable between the retracted position, a latching position in which the latch bolt is partly extended from the housing to a distance insufficient to preclude sliding up a strike plate during latching, and a fully extended position as shown in FIG. 11.

To facilitate latching of the extended length latch bolt the latch bolt assembly may include a disengageable detent to restrain the bolt from displacing under bias from the latching to the extended position thereby ensuring in normal operation that the bolt is held only partly extended until after latching with the strike plate.

Figure 14:
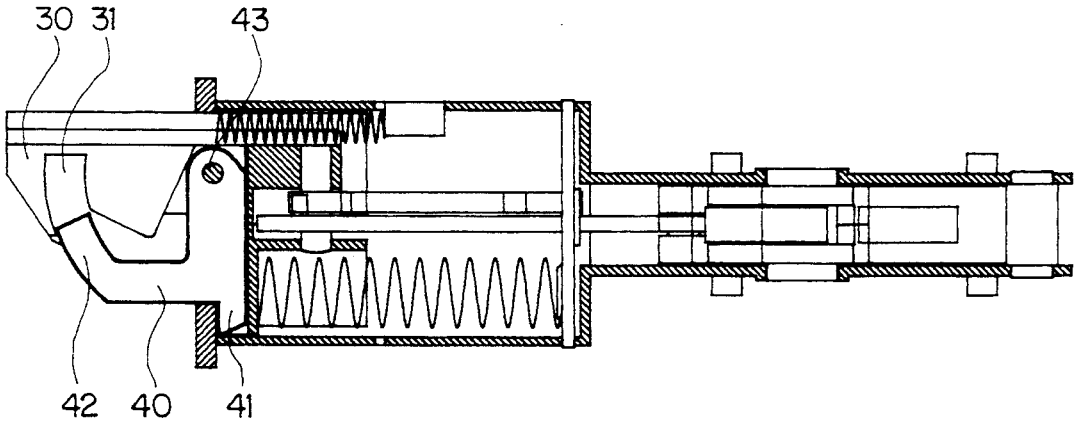
FIG. 14 is a tranverse fragmentary sectional view on the line 8—8 of FIG. 7 of the latch bolt subassembly when the latch bolt is of extended length and includes a latching lever.

Alternatively it may include a substantially conventional latching lever 40, as shown in FIGS. 13 and 14, adapted to be pin jointed 43 to the bolt as distinct from pivotally secured to the casing having an orthogonal first arm 41 which is engageable with the interior wall of the front plate and a second contoured arm 42 engageable with the strike plate whereby engagement with the strike plate during latching causes the second arm to move towards the latch bolt to cause the first arm to pivot and push backwards from the inside of the front plate to drive the latching lever pivot point to retract thereby retracting the latch bolt to the latching position to facilitate latching. Preferably, the latch bolt has a recess 31 to accommodate the end of the arm 42 of the latch lever 40 so as to preclude an exposed concave recess between lever and bolt, as shown in FIG. 14.

The disengageable detent comprises an adaption to the locking arm whereby the locking arm has, on the edge without shoulder 85, a hooked shoulder 86, as shown in FIG. 9. When the connecting arm pulls the bolt against bias inwardly, the locking arm first shoulder 85 is pivotally displaced away from the first shoulder 15 as described above and in doing so the hooked shoulder 86, being on the other side of the arm, is disposed towards a rear wall second abutment 16 whereby when the bolt has been retracted by the connecting arm to the latching position, the hook engages the second shoulder to restrain the bolt from displacing outwardly under spring bias.

An undepressed auxiliary bolt as described above also holds the locking arm in an unlocked position and also disposes the hook towards the second abutment.

Preferably the second abutment is angled backwards as is the engaging edge of the hook 86 so that if the auxiliary bolt alone is depressed the hook is retained engaged by the abutment. This precludes mischievous firing of the main latch bolt by a person pushing in the auxiliary bolt.

Figure 12:
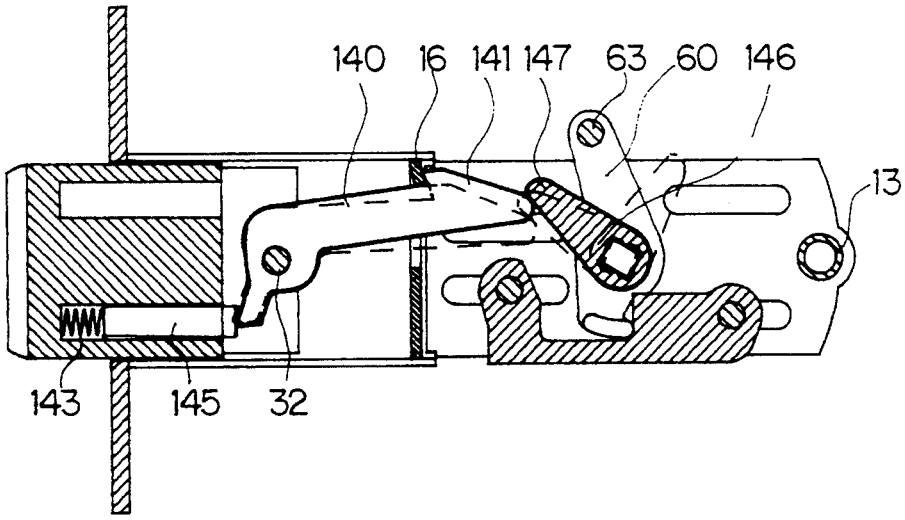
FIG. 12 is a cross sectional view on the line 12—12 of FIG. 1 of the latch bolt subassembly when the latch bolt is of extended length.

The deadlocking latch bolt assembly with extended length latch bolt may also optionally include a second independent detent to prevent the bolt from fully extending unless actuated by the key or thumbturn lock actuating means. This detent includes a pivotally displaceable retaining arm 140 with a hook 141, as shown in FIG. 12, positioned within the slot in the rear of the latch bolt attached by pin joint 32 to the bolt adjacent the locking arm. It has rotational biasing comprising a compression spring 143 and cylinder 145 similar to locking arm bias already described to dispose the hook on the retaining arm towards the case second abutment 16 which it engages when the bolt is in the latching position. A second pivotal member 146 adapted to provide an arm 147, as shown in FIG. 12, displaces the hook of the retaining arm from the second case abutment 16 as the spindle and second pivotal member are rotated by the coupled lock actuating means from the unlocked to the locked configuration. Rotation of the spindle causes the arm of the second pivotal member to pivot forward to engage the inside end of the retaining arm protruding from the back of the rear wall 19.

In one embodiment a lockset includes a pair of lever assemblies one of which has a locking means and the other includes a lock actuating means, a latch bolt assembly having conventional half inch bolt and a hub assembly. This lock when used has a fully extended deadlocked bolt within a strike plate, the shoulder 85 of the locking arm is engaged with the shoulder 15 of the rear wall, the slide 50 is fully back and the auxiliary bolt is held inwardly by the strike plate and a lever is unlocked. In this configuration the lock actuating means may be displaced between locked and unlocked positions. Rotation of the lever causes the cam 120 to rotate and displace the slide plate 130 which in turn causes the drive slide 50 to translate. Shoulder 52 of the drive slide drives forward counter pivot arm 64 of the first pivotal member so that the pin joint 63 is drawn inwardly. The connecting arm moves fractionally to engage the arm 83 of the locking member and a little further displacement pivots the shoulder 85 of the arm out of engagement with the shoulder 15. Further displacement of the connecting arm draws the bolt inward while holding the locking member towards abutment 16. When the bolt has been fully retracted and the bolt moved out of engagement with the strike plate, the auxiliary bolt shoulder 92 moves into engagement with the first extension arm 82 of the locking arm.

In some applications the standard ANSI/BHMA A156.2-1989 requires that door closing and the consequential bolt depression unlock the locking means if it has been actuated to the locked position prior to door closing. For these and similar applications the second pivotal member is included in the lockset.

In this embodiment a lock having an extended length bolt includes a locking arm having a detent including a hook, as shown in FIGS. 9 and 10. Rotation of the lever causes the cam 120 to rotate and displace the slide plate 130 which in turn causes the drive slide 50 to translate. Shoulder 52 of the drive slide drives forward counter-pivot 64 of the pivotal member so that the pivot point 63 is drawn inwardly. The connecting arm moves fractionally to engage the arm 63 of the locking member and a little further displacement pivots the shoulder 85 of the arm out of engagement with the shoulder 15 of the backplate. Further displacement of the connecting arm draws the bolt inward while holding the locking member towards shoulder 16. When the bolt has been retracted to the latching position the hooked shoulder 86 engages the shoulder 16 at which point the bolt would be restrained against outward displacement. When the bolt has been fully retracted and the bolt moved out of engagement with the strike plate the auxiliary bolt shoulder 92 moves into engagement with the first extension arm 82 of the locking arm to hold the locking arm away from the first abutment. When the lever is then rotated back to the normal latching position the bolt is displaced outwardly until the hook engaged the second abutment to hold the bolt in the extended bolt latching bolt position. When the door is then closed and the latch bolt engages the strike plate the bolt slides up the strike plate until the bolt passes over the strike plate recess at which point it displaces to the fully extended position, the auxiliary bolt having been depressed and the shoulder 92 inwardly displaced from arm 82

If the lockset were to include a restraining arm as well, the bolt would not displace to the fully extended position until the lock actuating means had been actuated to the locked position during which rotation the restraining arm would have been displaced from the second abutment.

DETAILED DESCRIPTION OF DRAWINGS

FIG. 1 is a tranverse fragmentary sectional view of a door and door jamb showing a complete lockset mounted in operating position.

FIG. 2 is a sectional view on the line 2—2 of FIG. 1, showing the relationship between the portion of the latch bolt assembly within the hub casing, the drive mechanisms on both sides of the latch bolt assembly within the hub casing, the independent drive shafts, the fixing screws which clamp the fixing roses to the faces of the door while passing through holes in the hub casing to retain the hub in position and a spindle passing longitudinally through the centre of the hub by which a locking means may be connected.

FIG. 3 is a cross-sectional view on the line 3—3 of FIG. 2 showing the relationship between components of a drive mechanism and more specifically the proximity between the wedge portion on the face of the cam and the ramped aperture of the slide plate when both are in the undisplaced position and the latch bolt is extended.

FIG. 4 is a cross-sectional view on the line 3—3 of FIG. 2 showing the relationship between components of a drive mechanism and more specifically the engagement between the wedge portion on the face of the cam and the planar ramped aperture of the slide plate when the cam has been fully rotated by a lever to drive the slide plate forward to retract tile latch bolt.

FIG. 5 is a cross-sectional view on the line 5—5 of FIG. 2 showing the relationship between the slide plate and the protruding pins of the latch bolt subassembly and more specifically it shows the shoulders on the face of the slide plate positioned in proximity behind the pins when the drive slide is undisplaced and the latch bolt is extended.

FIG. 6 is a cross-sectional view on the line 5—5 of FIG. 2 showing the relationship between the slide plate and the protruding pins of the latch bolt subassembly and more specifically it shows the shoulders on the face of the slide plate positioned behind the pins and engaging the pins when the pins have been fully displaced by the slide plate. The latch bolt is shown retracted.

FIG. 7 is a cross sectional view on the line 7—7 of FIG. 1 of the latch bolt subassembly. More specifically it shows, a latch bolt in the extended deadlocked position, the locking arm first shoulder engaging the abutment of the casing rear wall, the 10 connecting arm pin jointed to the bolt and first pivotal member and the drive slide slidably supported by pins. It also shows an optional second pivotal member which has been rotated from the dotted position to the position engaging the connecting arm by the rectangular spindle passing through it.

FIG. 8 is a tranverse fragmentary sectional view along the line 8—8 of the latch bolt subassembly of FIG. 7, showing a rectangular spindle passing through the optional second pivotal member.

FIG. 9 is a cross sectional view on the line 7—7 of FIG. 1 of the latch bolt subassembly when the latch bolt is of extended length. More specifically it shows, an extended length latch bolt in the extended deadlocked position, the locking arm first shoulder engaging the abutment of the casing rear wall, the connecting arm pin jointed to the bolt and first pivotal member and the drive slide slidably supported by pins. It also shows the locking arm with the optional hook and second locking shoulder. The optional second pivotal member with rectangular spindle hole is shown engaging the connecting arm.

FIG. 10 is a cross sectional view on the line 7—7 of FIG. 1 of the latch bolt subassembly when the latch bolt is of extended length. More specifically it shows, an extended length latch bolt in the latching position, the locking arm hook engaging the second casing abutment of the casing rear wall to hold the latch bolt partly extended, the connecting arm pin jointed to the bolt and first pivotal member and the drive slide slidably supported by pins.

FIG. 11 is an isometric view of the latch bolt sub assembly

FIG. 12 is a cross sectional view on the line 12—12 of FIG. 1 of the latch bolt subassembly when the latch bolt is of extended length. More specifically it shows, an extended length latch bolt in the latching position, the optional retaining arm hook engaging the second casing abutment of the casing rear wall to hold the latch bolt partly extended, the connecting arm pin jointed to the bolt and first pivotal member and the drive slide slidably supported by pins. It also shows an optional second pivotal member with rectangular spindle hole which has been rotated from the dotted position to the position engaging the retaining arm.

FIG. 13 is an isometric view of a latch bolt subassembly including a latching lever. More specifically it shows a latching lever first arm engaging the inside face of the face plate and a second curved arm protruding from the latch face of the bolt. It also shows the recess within the bolt in which the second arm pivotally displaces.

FIG. 14 is is a tranverse fragmentary sectional view along the line 8—8 of the latch bolt subassembly of FIG. 7 including a latch lever.

Having now described my invention, what I claim is:

1. A lock for a hinged door comprising a deadlocking latch bolt assembly including a casing, a latch bolt supported within the casing and displaceable between an extended and a retracted position and biasing means for urging the bolt towards said extended position;

bolt actuating means for displacing the bolt towards said retracted position, said bolt actuating means including displaceable slide means, a connecting arm engageable with said bolt, and crank means engageable with said slide means and said connecting arm for displacing said bolt towards said retracted position;

a pair of independently operable lever assemblies positioned one on each side of the deadlocking latch bolt assembly, each lever assembly including a rotatable lever and a rotatable drive shaft engageable with said lever and independent drive means positioned on each side of said slide means and engageable with the drive shaft on the same side, each drive means independently engageable with said slide means to cause said slide means to be displaced to cause said bolt to displace towards said retracted position.

2. A lock according to claim 1, wherein said slide means is comprised of a pair of slide plates operable by each of said independent drive means, respectively, and a drive slide slidably mounted in said latch bolt assembly for engagement by said slide plates and wherein said crank means is comprised of a first pivotal member supported in said latch bolt assembly coaxial with said lever assemblies and engageable with said drive slide and said connecting arm.

3. A lock according to claim 2, wherein each drive means includes a rotationally displaceable cam disc having an axis of rotation coaxial with a drive shaft axis, one side of said cam disc comprises a tubular boss which engages the drive shaft and another side comprising a cam engageable with one of said slide plates which is positioned between the cam disc and said drive slide of the latch bolt assembly with a main surface orthogonal to the drive shaft axis and parallel to an adjacent surface of the disc with which it is engageable, said slide plate being moveable in translation in a direction parallel to the direction of movement of the drive slide with which it is engageable, whereby the drive slide is displaceable by displacement of an adjacent slide plate caused by rotation of a respective cam resulting from drive shaft rotation.

4. A lock according to claim 3, wherein each slide plate has a ramped aperture adjacent a back edge in which said cam on the cam disc locates in cam follower relationship to cause the slide plate to translate as the disc rotates; the slide plate having a face adjacent the drive slide with protrusions engageable with pins protruding from the drive slide.

5. A lock according to claim 2, wherein at least one lever assembly includes a locking means displaceable between a locked configuration where the lever is prevented from rotating the adjacent shaft and an unlocked configuration where lever rotation rotates the shaft, said at least one lever assembly including a lock actuating means coupled to the locking means for selectively displacing the locking means between locked and unlocked configurations, a spindle independent of said drive shaft connected to said locking means and extending into said latch bolt assembly and lever means operatively engageable between said spindle and said latch bolt to provide operative interaction between said latch bolt and said locking means.

6. A lock according to claim 5, wherein the locking means is displaceable from the locked to the unlocked configuration by inward displacement of the latch bolt, said lever means comprising a second pivotal member coaxially mounted adjacent the first pivotal member in said latch bolt assembly and operably engageable with the spindle, said second pivotal member being engageable by the connecting arm whereby in operation, the spindle and second pivotal member are rotationally displaceable in one direction coincidently with actuation of the locking means to the locked configuration and displaceable in the opposite direction by inward displacement of the bolt causing the connecting arm to drive the second pivotal member whereby the locking means is coincidently displaced to the unlocked configuration.

7. A lock according to claim 1, including a deadlocking means to prevent inward displacement of said bolt by means other than displacement of the connecting arm, said deadlocking means including a pivotally displaceable locking arm attached to the bolt and an outwardly biased slidable auxiliary bolt supported within the latch bolt casing, said deadlocking means also including a first casing abutment, a first shoulder on the free end of the locking arm and rotational biasing means for biasing the shoulder towards the first abutment which when engaged deadlocks the latch bolt to restrain it from depression, said first shoulder being displaceable against said rotational biasing means away from the first abutment by a small inward displacement of the connecting arm relative to the bolt wherein a third shoulder on the locking arm which is radially disposed and adjacent a pivot point of the arm is engaged by a mating fourth shoulder on the connecting arm whereby the small displacement of the connecting arm causes rotation of the locking arm, said auxiliary bolt including a return rearward shoulder, which when the auxiliary bolt is undepressed engages the locking arm retaining the first locking arm shoulder away from the first casing abutment to facilitate inward bolt depression by engagement with a strike plate during latching and on relative depression by the strike plate during latching disengaging the locking arm to allow the locking arm shoulder to displace towards the first casing abutment.

8. A lock according to claim 7, wherein the latch bolt is an extended length latch bolt and is displaceable between the retracted position, a latching position in which the latch bolt is partly extended from the housing by a distance insufficient to preclude sliding up a strike plate during latching, and the extended position and further comprising at least one disengageable detent to restrain the bolt from displacing under bias from the latching to the extended position.

9. A lock according to claim 8, wherein said detent includes a second abutment on the bolt casing and a hook on the locking arm whereby the second abutment is engageable by the locking arm to restrain the bolt from displacing from the latching position to the fully extended position, said hook being displaceable towards and engageable by the second abutment by the small inward displacement of the connecting arm relative to the locking arm and held so displaced by the auxiliary bolt when the auxiliary bolt is undepressed.

10. A lock according to claim 8, including a second disengageable detent to independently restrain the bolt from displacing under bias from the latching to the extended position and being displaceable concurrently with actuation of the lock actuating means to the locked position to release the detent to allow the bolt to displace to the extended position.

11. A lock according to claim 10, wherein said second disengageable detent includes a pivotally displaceable retaining arm attached to the bolt, rotational biasing means for disposing a hook on the retaining arm towards an abutment on the casing which it engages when the bolt is in the latching position and displaceable against said biasing means away from the abutment by the engagement with the second pivotal member adapted to engage and displace the retaining arm as the spindle and second pivotal member are rotated by the lock actuating means as it is actuated from the unlocked to the locked configuration.

12. A lock according to claim 7, wherein the latch bolt is an extended length latch bolt and is displaceable between the retracted position, a latching position in which the latch bolt is partly extended from the housing by a distance insufficient to preclude sliding up the strike plate during latching and the extended position, said extended length latch bolt including a latching lever pivotally secured to the bolt and having orthogonal arms one of which is engageable with an interior side of a latch bolt casing front plate and the other engageable with the strike plate whereby engagement with the strike plate during latching causes the lever to pivot and cause the latching lever pivot point to retract thereby retracting the latch bolt to the latching position to facilitate latching.

13. A lock according to claim 12, wherein the exterior form of the assembly comprising the latch lever and each bolt is convex to preclude an external concave recess between the lever and bolt.

14. A lock according to claim 8, wherein a partly extended bolt may be deadlocked as a result of the locking arm having a second shoulder engageable with the first casing abutment when the bolt is partly extended.

15. A lock for a hinged door including a deadlocking latch bolt assembly including a casing, a latch bolt supported within the casing and displaceable between an extended and a retracted position and biasing means for urging said bolt towards said extended position;

a pair of independently operable lever assemblies positioned one on each side of the deadlocking latch bolt assembly, each lever assembly including a rotatable lever, and a rotatable drive shaft engageable with the lever, at least one lever assembly including a locking means displaceable between a locked configuration where the lever is prevented from rotating the adjacent shaft and an unlocked configuration where lever rotation rotates the shaft, said at least one lever assembly including a lock actuating means coupled to the locking means for selectively displacing the locking means between locked and unlocked configurations, a spindle independent of said drive shaft connected to said locking means and extending into said latch bolt assembly and, lever means operatively engageable between said spindle and said latch bolt to provide operative interaction between said latch bolt and said locking means.

16. A lock according to claim 15, further comprising a pivotally displaceable retaining arm pivotally mounted on said bolt, said retaining arm having a hook engageable with an abutment on said casing to retain said bolt in a partially extended position, wherein said lever means is comprised of a pivotal member mounted on said spindle and engageable with said retaining arm whereby upon displacement of said locking means to said locked configuration said spindle will rotate said pivotal member to disengage said hook from said abutment to allow said bolt to move to a fully extended position.

17. A lock according to claim 15, wherein said lever means comprises a pivotal member mounted on said spindle in said latch bolt assembly and further comprising a connecting arm pivotally connected to said latch bolt and engageable with said pivotal member whereby upon inward displacement of said bolt said connecting arm engages said pivotal member to rotate said spindle to displace said locking means from the locked to the unlocked configuration.

18. A lock according to claim 15, wherein at least one lever assembly includes an actuating means and a locking means displaceable between a locked configuration where the drive shaft is prevented from being driven by the adjacent lever and an unlocked configuration where the drive shaft may be driven by the adjacent lever; said locking means being selectively actuatable by the actuating means which may take the form of a key operable cylinder or a rotatable lever.

19. A lock according to claim 15, including a spindle wherein at least one lever assembly includes locking means and both lever assemblies include lock actuating means, said lock actuating means being operably coupled by the spindle interconnecting the locking means in one lever assembly to the lock actuating means in the other lever assembly.

* * * * *